US005979547A

United States Patent [19]

Shinmura et al.

[11] Patent Number: 5,979,547

[45] **Date of Patent: *Nov. 9, 1999**

[54] DISTRIBUTION DEVICE CAPABLE OF UNIFORMLY DISTRIBUTING A MEDIUM TO A PLURALITY OF TUBES OF A HEAT EXCHANGER

[75] Inventors: Toshiharu Shinmura; Tomohiro Chiba, both of Sawa-gun, Japan

[73] Assignee: Sanden Corporation, Gunma, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/822,833

[22] Filed: Mar. 24, 1997

[30] Foreign Application Priority Data

Mar. 22, 1996 [JP] Japan ..... 8-66032

[51] Int. Cl.[6] ..... F28F 9/22

[52] U.S. Cl. ..... 165/174; 165/153; 62/525

[58] Field of Search ..... 165/153, 174, 165/178; 62/525; 137/561 A

[56] References Cited

U.S. PATENT DOCUMENTS

| | | | |
|---|---|---|---|
| 2,044,455 | 6/1936 | Witzel | 62/525 |
| 2,099,186 | 11/1937 | Anderegg . | |
| 2,148,414 | 2/1939 | Wolfert et al. . | |
| 3,151,676 | 10/1964 | Otto et al. . | |
| 3,864,938 | 2/1975 | Hayes, Jr. . | |
| 3,976,128 | 8/1976 | Patel et al. . | |
| 4,153,106 | 5/1979 | Sonoda et al. . | |
| 4,458,750 | 7/1984 | Huber . | |
| 4,513,587 | 4/1985 | Humpolik et al. . | |
| 4,524,823 | 6/1985 | Hummel et al. . | |

FOREIGN PATENT DOCUMENTS

| | | |
|---|---|---|
| 0164327 | 12/1985 | European Pat. Off. . |
| 1015443 | 9/1952 | France . |
| 1128148 | 1/1957 | France . |
| 2194927 | 3/1974 | France . |
| 260566 | 11/1991 | Japan . |
| 260567 | 11/1991 | Japan . |
| 2250336 | 6/1992 | United Kingdom . |

*Primary Examiner*—Leonard Leo
*Attorney, Agent, or Firm*—Baker & Botts, L.L.P.

[57] ABSTRACT

In a distribution device (1) including a distribution tank (3) supplied with a mixed-phase medium consisting essentially of a gas-phase medium and a liquid-phase medium, and a plurality of distribution paths (4), each of which has a medium inlet port and a medium outlet port coupled to the distribution tank and a heat exchanger, respectively, and which are for directing the mixed-phase medium from the distribution tank to the heat exchanger, the medium inlet ports of the plurality of distribution paths are coupled to the distribution tank substantially along an equal void ratio line defined by connecting those points of the distribution tank which are equal in a void ratio to each other, where the void ratio is defined as a ratio of the volume of the gas-phase medium to the volume of both the gas-phase medium and the liquid-phase medium. Typically, the medium outlet ports of the distribution paths are coupled to a plurality of exchanger tubes of the heat exchanger, respectively.

9 Claims, 17 Drawing Sheets

DISTRIBUTION DEVICE CAPABLE OF UNIFORMLY DISTRIBUTING A MEDIUM TO A PLURALITY OF TUBES OF A HEAT EXCHANGER

BACKGROUND OF THE INVENTION

This invention relates to a distribution device for use in combination with a heat exchanger to uniformly distribute a medium to a plurality of tubes of the heat exchanger. This invention also relates to the heat exchanger equipped with the above-mentioned distribution device.

Generally, the efficiency of a heat exchanger is affected not only by heat transfer of an outer fluid flowing outside of a plurality of tubes of the heat exchanger but also by heat transfer of an inner fluid flowing inside of the tubes. In particular, flow distribution of the inner fluid has a great influence. By way of example, consideration will be made about an evaporator as the heat exchanger. A mixed-phase refrigerant as a mixture of a gas-phase refrigerant and a liquid-phase refrigerant is introduced into a plurality of tubes of the evaporator. Due to the difference in inertial force, the gas-phase and the liquid-phase refrigerants are not uniformly distributed in the mixed-phase refrigerant supplied to the evaporator. In other words, the mixed-phase refrigerant inevitably has different void ratios at various points in a flow path. In the present specification, a void ratio is defined as a ratio of the volume of the gas-phase refrigerant to the volume of the mixture of the gas-phase and the liquid-phase refrigerants. Under the circumstances, the liquid-phase refrigerant is concentrated to a particular tube while the gas-phase refrigerant is concentrated to another tube. This brings about nonuniform temperature distribution within the evaporator. As a result, the efficiency of the heat exchanger is deteriorated.

For example, a conventional heat exchanger is disclosed in Japanese Unexamined Patent Publication (JP-A) No. 155194/1992. In the conventional heat exchanger, however, it is impossible to uniformly distribute the refrigerant to a plurality of tubes of the heat exchanger, as will later be described.

SUMMARY OF THE INVENTION

It is therefore an object of this invention to provide a distribution device capable of uniformly distributing a medium to a plurality of tubes of a heat exchanger.

It is another object of this invention to provide a combination of a heat exchanger and a distribution device capable of uniformly distributing a medium to a plurality of tubes of the heat exchanger.

Other objects of this invention will become clear as the description proceeds.

According to a first aspect of this invention, there is provided a distribution device for use in combination with a heat exchanger, the distribution device comprising a distribution tank supplied with a mixed-phase medium consisting essentially of a gas-phase medium and a liquid-phase medium, and a plurality of distribution paths, each of which has a medium inlet port and a medium outlet port coupled to the distribution tank and the heat exchanger, respectively, and which are for directing the mixed-phase medium from the distribution tank to the heat exchanger, wherein: the medium inlet ports of the plurality of distribution paths are coupled to the distribution tank substantially along an equal void ratio line defined by connecting those points of the distribution tank which are equal in a void ratio to each other, where the void ratio is defined as a ratio of the volume of the gas-phase medium to the volume of both the gas-phase medium and the liquid-phase medium.

According to a second aspect of this invention, there is provided a distribution device for use in combination with a heat exchanger, the distribution device comprising a distribution tank supplied with a mixed-phase medium consisting essentially of a gas-phase medium and a liquid-phase medium, and a plurality of distribution paths, each of which has a medium inlet port and a medium outlet port coupled to the distribution tank and the heat exchanger, respectively, and which are for directing the mixed-phase medium from the distribution tank to the heat exchanger, wherein: the medium inlet ports of the plurality of distribution paths are coupled to the distribution tank substantially along an equal void ratio plane defined by connecting those points of the distribution tank which are equal in a void ratio to each other, where the void ratio is defined as a ratio of the volume of the gas-phase medium to the volume of both the gas-phase medium and the liquid-phase medium.

According to a third aspect of this invention, there is provided a combination of a heat exchanger and a distribution device, the distribution device comprising a distribution tank supplied with a mixed-phase medium consisting essentially of a gas-phase medium and a liquid-phase medium, and a plurality of distribution paths, each of which has a medium inlet port and a medium outlet port coupled to the distribution tank and the heat exchanger, respectively, and which are for directing the mixed-phase medium from the distribution tank to the heat exchanger, wherein: the medium inlet ports of the plurality of distribution paths are coupled to the distribution tank substantially along an equal void ratio line defined by connecting those points of the distribution tank which are equal in a void ratio to each other, where the void ratio is defined as a ratio of the volume of the gas-phase medium to the volume of both the gas-phase medium and the liquid-phase medium.

According to a fourth aspect of this invention, there is provided a combination of a heat exchanger and a distribution device, the distribution device comprising a distribution tank supplied with a mixed-phase medium consisting essentially of a gas-phase medium and a liquid-phase medium, and a plurality of distribution paths, each of which has a medium inlet port and a medium outlet port coupled to the distribution tank and the heat exchanger, respectively, and which are for directing the mixed-phase medium from the distribution tank to the heat exchanger, wherein: the medium inlet ports of the plurality of distribution paths are coupled to the distribution tank substantially along an equal void ratio plane defined by connecting those points of the distribution tank which are equal in a void ratio to each other, where the void ratio is defined as a ratio of the volume of the gas-phase medium to the volume of both the gas-phase medium and the liquid-phase medium.

DESCRIPTION OF THE PREFERRED EMBODIMENTS

In order to facilitate an understanding of this invention, description will at first be made about several conventional heat exchangers with reference to FIGS. 1 through 4.

Figure 1:
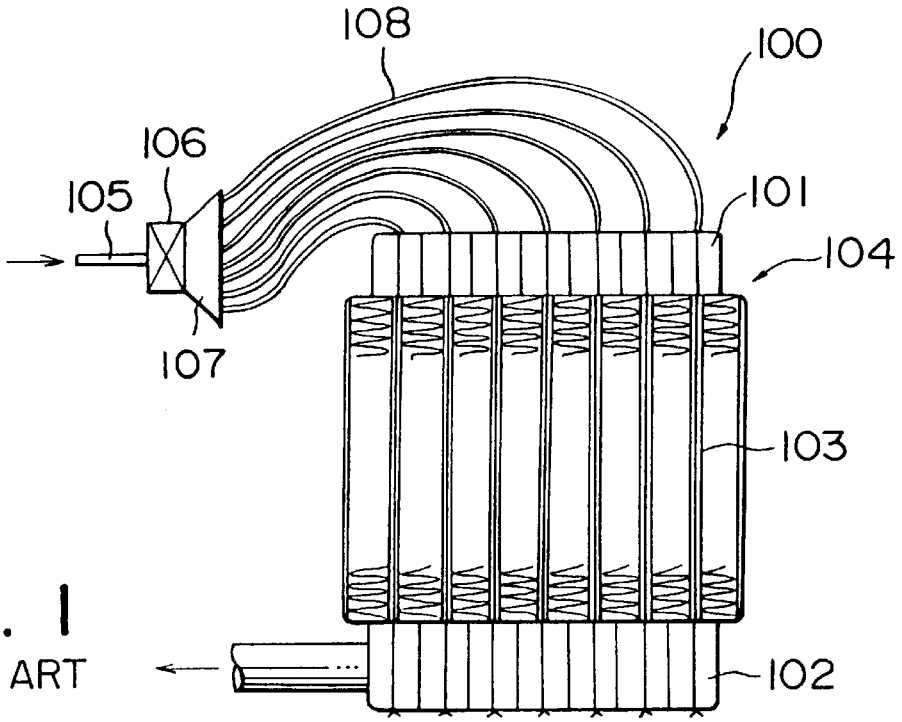
FIG. 1 PRIOR ART
FIG. 1 is a front view of a first conventional heat exchanger equipped with a distribution device.

Referring to FIG. 1, a conventional evaporator 100 with a distribution device comprises a stack of a plurality of fluid passage tubes 104. Each tube 104 has a pair of tank portions 101 and 102 for distribution and collection of a refrigerant and a tube portion 103 for fluid communication between the tank portions 101 and 102. A plurality of the tank portions 101 forms an entrance tank at an upper end of the evaporator 100 while a plurality of the tank portions 102 forms an exit tank at a lower end of the evaporator 100. A refrigerant introduction pipe 105 for introducing a refrigerant into the evaporator 100 has one end connected to a throttle portion 106. The throttle portion 106 is coupled to a distribution tank 107 connected to a plurality of distribution pipes (distribution paths) 108. The distribution pipes 108 are coupled to the tank portions 101 to communicate with the tubes 104 in one-to-one correspondence. In the above-described conventional evaporator, a combination of the throttle portion 106, the distribution tank 107, and the distribution pipes 108 forms the distribution device. The distribution device aims to uniformly distribute the refrigerant to the respective tubes 104.

The above-described evaporator has a large number of the distribution pipes which require a complicated fitting operation and a large layout space. In order to facilitate the fitting operation and to reduce the layout space, the above-mentioned Japanese Unexamined Patent Publication (JP-A) No. 155194/1992 discloses various modifications in which a multihole pipe 109 as a single distribution pipe is arranged in the entrance tank of the heat exchanger 100, as illustrated in FIGS. 2 through 4.

In the conventional evaporator illustrated in FIG. 1, the refrigerant passing through the throttle portion has a gas/liquid mixed phase in the distribution tank and can not be uniformly distributed to the distribution pipes which are simply connected to the distribution tank without any special consideration.

Figure 2:
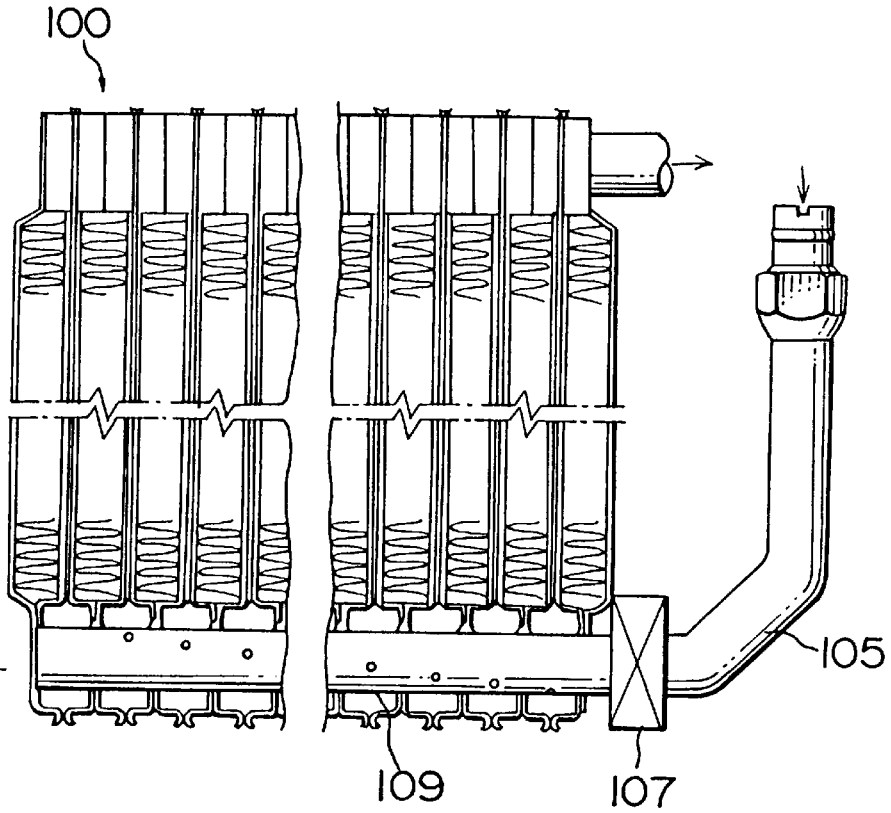
FIG. 2 PRIOR ART
FIG. 2 is a front view of a second conventional heat exchanger equipped with a distribution device.
Figure 3:
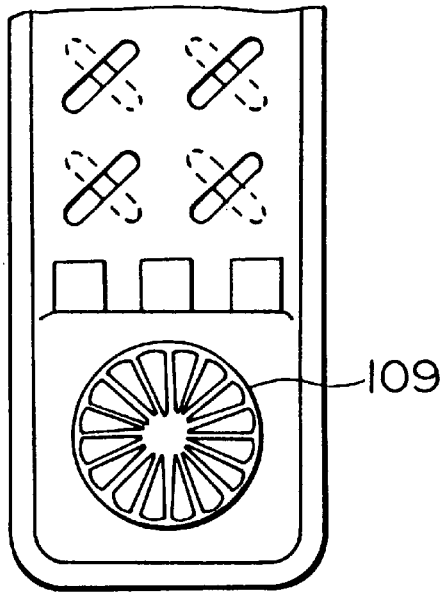
FIG. 3 PRIOR ART
FIG. 3 schematically shows a characteristic portion of a third conventional heat exchanger equipped with a distribution device.
Figure 4:
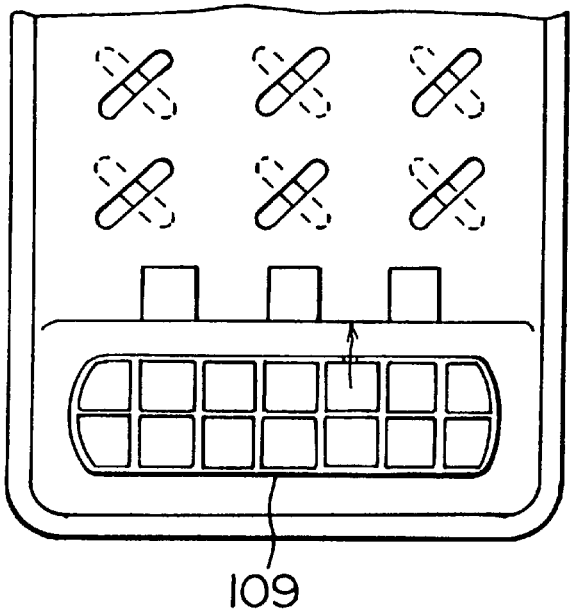
FIG. 4 PRIOR ART
FIG. 4 schematically shows a characteristic portion of a fourth conventional heat exchanger equipped with a distribution device.

On the other hand, the conventional evaporators illustrated in FIGS. 2 through 4 are effective to simplify the fitting operation and to reduce the layout space. However, uniform distribution of the refrigerant to the tubes can not be achieved unless the refrigerant is uniformly introduced into the multihole pipe 109. The above-referenced Japanese publication makes no reference to an arrangement for uniformly introducing the refrigerant into the multihole pipe.

Next referring to FIGS. 5 through 13, the gist of this invention will be described by the use of first through third embodiment of this invention.

A distribution device 1 according to this invention achieves uniform distribution of a medium by coupling a plurality of distribution paths 4 to a distribution tank 3 in conformity with a condition of the medium within the distribution tank 3. The condition of the medium within the distribution tank 3 widely varies depending upon a flowing direction of the medium and a coupling direction of the distribution paths 4 with respect to the distribution tank 3. For example, in FIG. 5, the flowing direction of the medium passing through the throttle portion 2 is substantially aligned with the coupling direction of the distribution paths 4 with respect to the distribution tank 3. In this event, the medium within the distribution tank 3 has a condition which will presently be described. It is noted here that the medium is a two-phase medium consisting essentially of a gas-phase medium and a liquid-phase medium. Subjected to an inertial force resulting from a centrifugal force, the distribution tank 3 is rich with the gas-phase medium and the liquid-phase medium in a central area and a peripheral area near to a wall, respectively. Herein, let a void ratio be defined as a ratio of the volume of the gas-phase medium to the volume of both the gas-phase medium and the liquid-phase medium. In addition, an equal-void-ratio line is defined as a line determined by connecting those points of an equal void ratio within the distribution tank 3. In the above-described case, the void ratio has a distribution illustrated in FIG. 6 which is a sectional view of the distribution tank 3. The equal-void-ratio lines are depicted by dashed lines in the figure.

Figure 8:
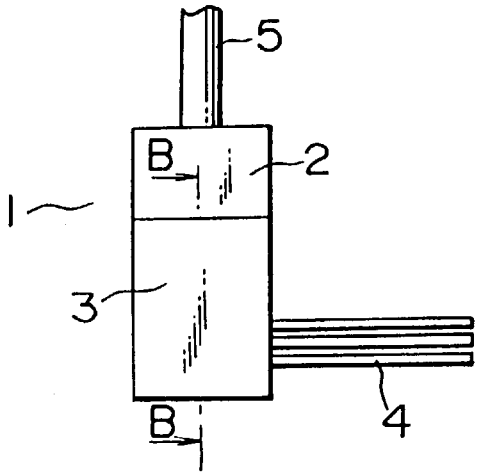
FIG. 8 is a side view of a distribution device according to a second embodiment of this invention.
Figure 9:
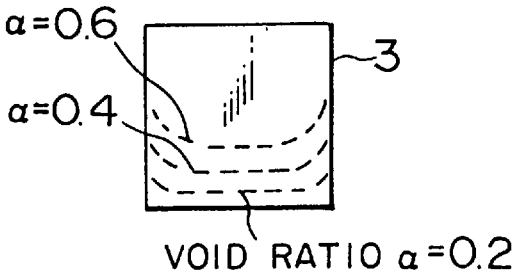
FIG. 9 is a sectional view taken along a line B—B in FIG. 8 for describing equal-void-ratio lines.

On the other hand, in FIG. 8, the flowing direction of the medium passing through the throttle portion 2 is substantially perpendicular to the coupling direction of the distribution paths 4 with respect to the distribution tank 3. In this event, distribution of the void ratio is caused in the flowing direction of the medium under the action of the inertial force resulting from the flow of the medium. Specifically, the distribution tank 3 is rich with the gas-phase medium and the liquid-phase medium in the vicinity of an upstream side (near to an introduction pipe 5) and in an inner area, respectively. Accordingly, the equal-void-ratio lines are drawn as illustrated in FIG. 9.

Figure 11:
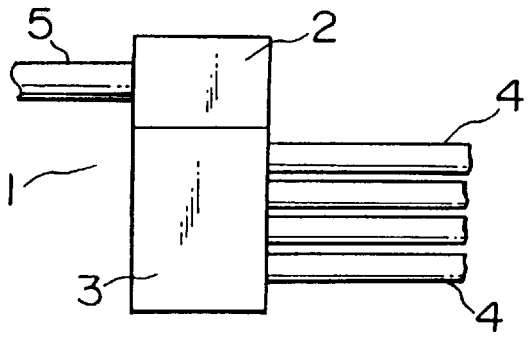
FIG. 11 is a plan view of a distribution according to a third embodiment of this invention.
Figure 12:
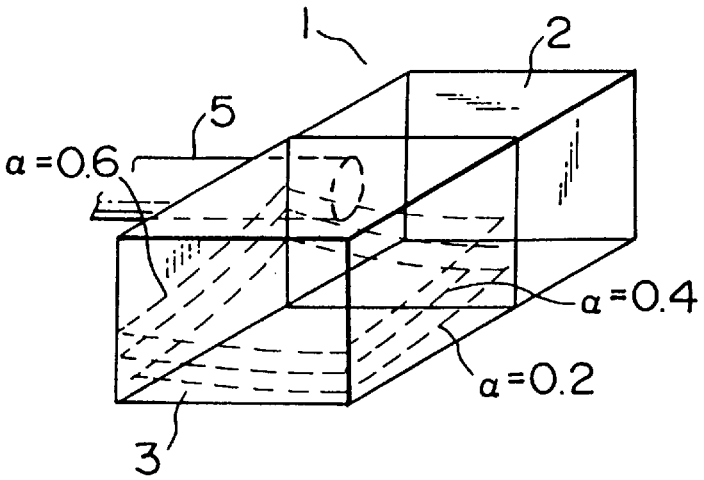
FIG. 12 is a perspective view showing equal-void-ratio planes in the distribution device illustrated in FIG. 11.

Alternatively, in FIG. 11, the flowing direction of the medium passing through the throttle portion 2 is neither aligned with nor simply perpendicular to the coupling direction of the distribution paths 4 with respect to the distribution tank 3. In this event, an equal-void-ratio plane is determined by a set of corresponding equal-void-ratio lines. By way of example, three equal-void-ratio planes are illustrated in FIG. 12. Specifically, the medium passing through the throttle portion 2 has gas/liquid distribution in its flowing direction of the medium and then turns in a perpendicular direction as a new flowing direction. Another gas/liquid distribution is caused in the new flowing direction and superposed on the initial gas/liquid distribution.

Figure 5:
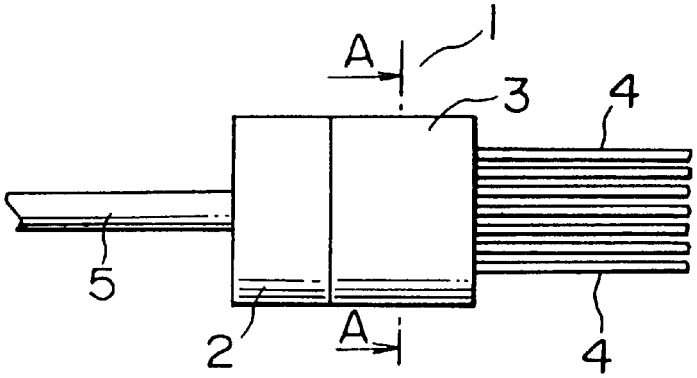
FIG. 5 is a side view of a distribution device according to a first embodiment of this invention.
Figure 6:
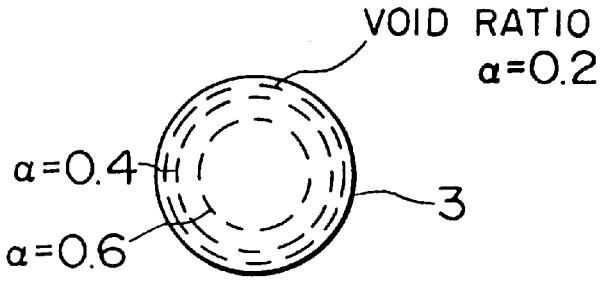
FIG. 6 is a sectional view taken along a line A—A in FIG. 5 for describing equal-void-ratio lines.
Figure 7:
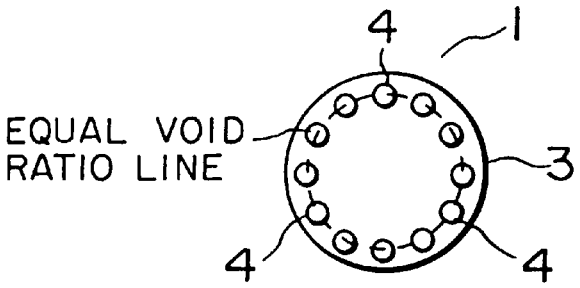
FIG. 7 is a front view of the distribution device illustrated in FIG. 5.

More specifically, in case of the coupling mode illustrated in FIG. 5, the equal-void-ratio lines are drawn along substantially concentric circles as illustrated in FIG. 6. Therefore, the medium can be uniformly distributed if the distribution paths 4 are arranged along a selected one of the concentric circles or the equal-void-ratio lines, as illustrated in FIG. 7. The selected one of the equal-void-ratio lines is selected in consideration of the number of the distribution paths 4 and of the pitch between the distribution paths 4. At a first glance, this structure seems to resemble the prior art structure illustrated in FIG. 3 as one of the modifications of the multihole pipe disclosed in the above-referenced Japanese publication. In fact, such seeming resemblance has no significance. As described above, the Japanese publication makes no reference to the arrangement for uniformly introducing the medium into the multihole pipe. Besides, in the structure illustrated in FIG. 3, each refrigerant path extend in a radial direction across a plurality of equal-void-ratio lines. It is therefore impossible with this structure to uniformly distribute the medium.

Figure 10:
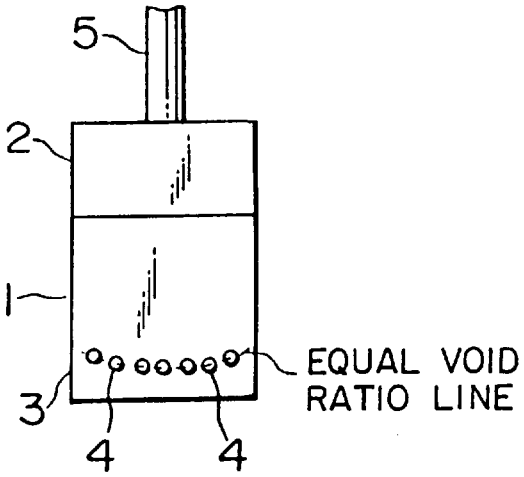
FIG. 10 is a front view of the distribution device illustrated in FIG. 8.

In case of the coupling mode illustrated in FIG. 8, the medium can be uniformly distributed if the distribution paths 4 are arranged substantially along a selected one of the equal-void-ratio lines, as illustrated in FIG. 10.

Figure 13:
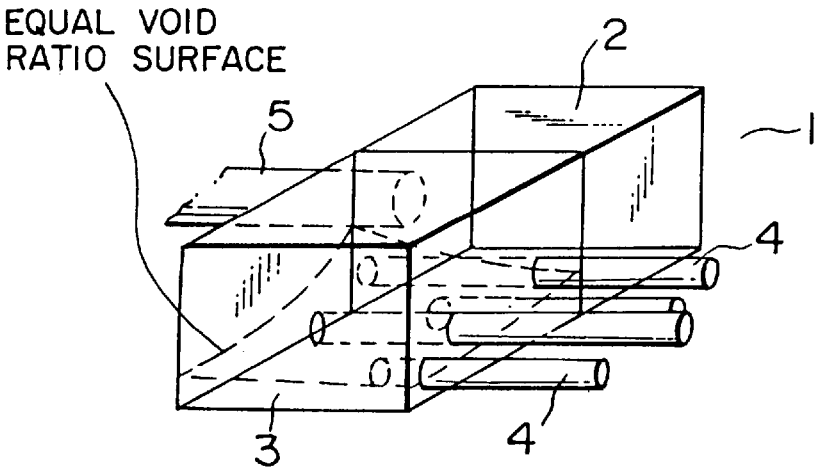
FIG. 13 is a perspective view for describing coupling of distribution pipes illustrated in FIG. 11.

In case of the coupling mode illustrated in FIG. 11, the void ratio has a three-dimensional distribution in the form of the equal-void-ratio planes as illustrated in FIG. 12. In this event, insertion depths of top ends of the distribution paths 4 into the distribution tank 3 are changed so that the top ends are arranged substantially along a selected one of the equal-void-ratio planes as illustrated in FIG. 13. Thus, the medium is uniformly distributed.

As described above, by arranging the medium inlet ports of the distribution paths 4 substantially along either the equal-void-ratio line or the equal-void-ratio plane, the mass flow of the medium distributed to each tube is kept substantially equal. In this event, centers of the medium inlet ports of the distribution paths 4 are typically arranged substantially along the equal-void-ratio line or plane. It is therefore possible to achieve uniform temperature distribution in a heat exchanger. This results in an improvement in efficiency of the heat exchanger.

Again referring to FIGS. 5 through 7, the distribution device 1 according to the first embodiment of this invention will be described in detail.

The distribution device 1 according to the first embodiment comprises the throttle portion 2, the distribution tank 3, and the distribution paths or pipes 4. The flowing direction of the medium flowing from the throttle portion 2 into the distribution tank 3 is substantially aligned with the coupling direction of the distribution pipes 4 with respect to the distribution tank 3. The throttle portion 2 is connected to one end of the introduction pipe 5. The throttle portion 2 may be omitted provided that an expansion valve is arranged in another section of a refrigerant circuit (not shown). The distribution tank 3 is coupled to the throttle portion 2. Within the distribution tank 3, the equal-void-ratio lines are drawn as illustrated in FIG. 6. The distribution pipes 4 has one ends (medium inlet ports) coupled to the distribution tank 3 along one of the equal-void-ratio lines and the other ends (medium outlet ports) coupled to a plurality of chambers formed in a tank of the heat exchanger (not shown), respectively.

In this embodiment, the void ratio has a two-dimensional distribution. Therefore, the insertion depths of the distribution pipes 4 into the distribution tank 3 can be equal or constant.

Turning to FIGS. 8 through 10, the distribution device 1 according to the second embodiment of this invention will be described.

The distribution device 1 according to the second embodiment comprises the throttle portion 2, the distribution tank 3, and the distribution pipes 4, like the foregoing embodiment. However, the flowing direction of the medium flowing from the throttle portion 2 into the distribution tank 3 is substantially perpendicular to the coupling direction of the distribution pipes 4 with respect to the distribution tank 3.

In this embodiment also, the void ratio has a two-dimensional distribution. Therefore, the insertion depths of the distribution pipes 4 into the distribution tank 3 can be constant or equal.

Next referring to FIGS. 11 through 13, the distribution device according to the third embodiment of this invention will be described.

The distribution device 1 according to the third embodiment comprises the throttle portion 2, the distribution tank 3, and the distribution pipes 4, like the foregoing embodiments. However, the flowing direction of the medium flowing from the throttle portion 2 into the distribution tank 3 is neither substantially aligned with nor substantially perpendicular to the coupling direction of the distribution pipes 4 with respect to the distribution tank 3. In this embodiment, the one ends (medium inlet ports) of the distribution pipes 4 are coupled to the distribution tank 3 along one of the equal-void-ratio planes.

Figure 14:
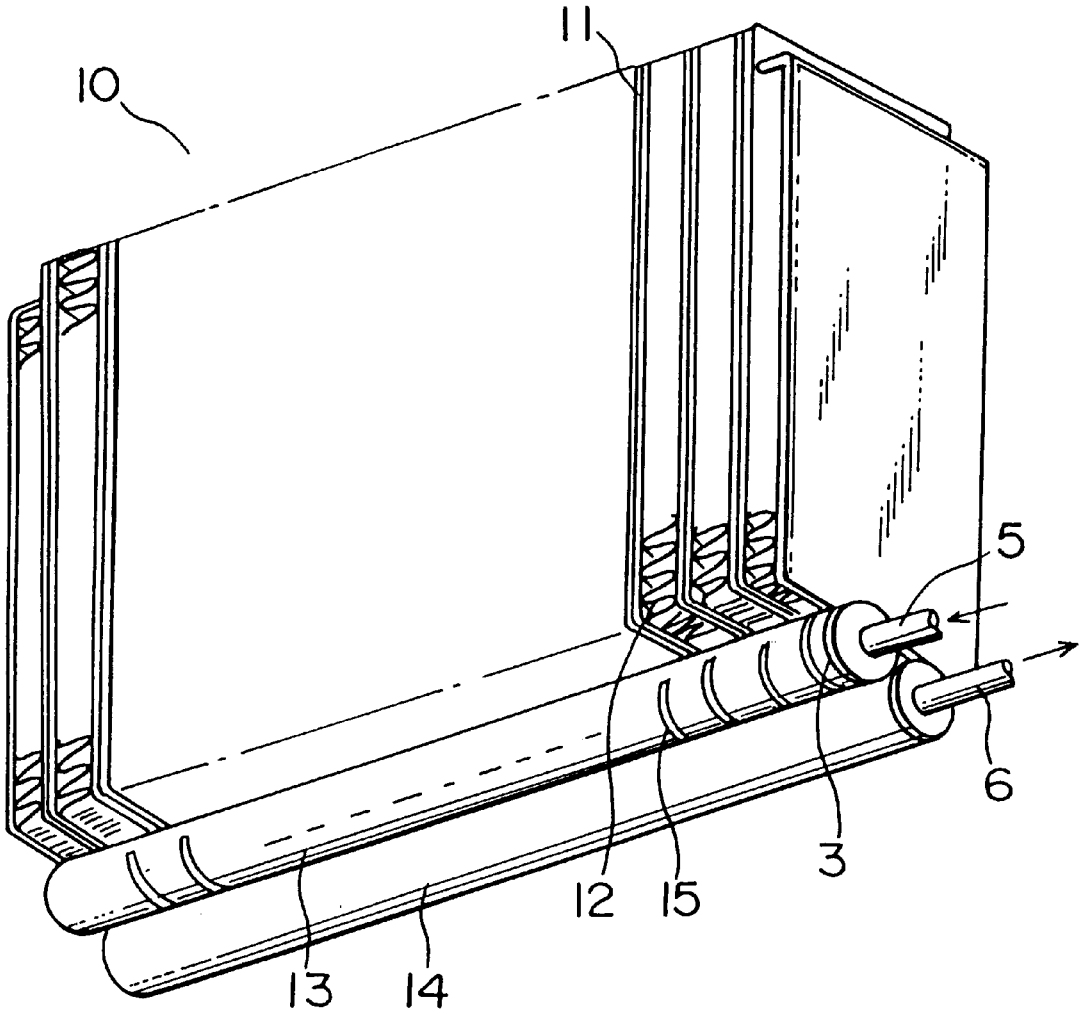
FIG. 14 is a perspective view of a heat exchanger according to a fourth embodiment of this invention.

Referring to FIG. 14, a heat exchanger 10 according to a fourth embodiment of this invention is manufactured as follows. A pair of molded plates are prepared by pressing a plate material. The molded plates are symmetrically coupled to form a tube 11. A plurality of the tubes 11 and fins 12 are stacked together. At one ends of the tubes 11, an entrance tank 13 and an exit tank 14 are arranged for distribution and collection of the medium. The heat exchanger 10 is of a so-called drawn cup type or plate-fin type. In this case, a refrigerant introduced from the throttle portion (not shown) flows into the distribution tank 3 to be distributed to the distribution pipes (not shown). The distribution pipes are supported by partitions 15.

Figure 15:
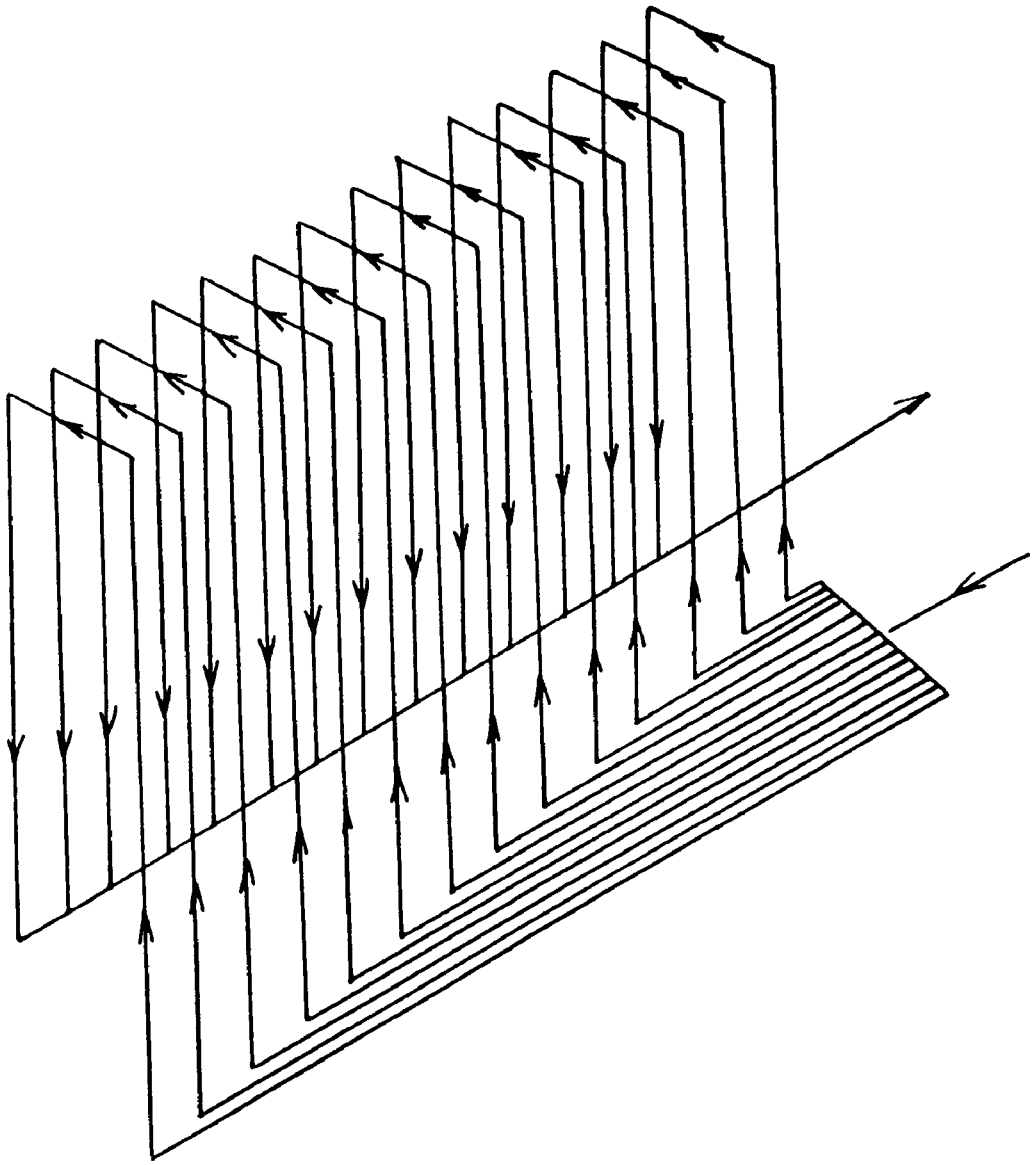
FIG. 15 is a view for describing the flow of a refrigerant in the heat exchanger illustrated in FIG. 14.

The flow of the refrigerant in the heat exchanger 10 is illustrated in FIG. 15. The refrigerant is supplied from the introduction pipe 5 and passes through the distribution tank 3 and the distribution pipes to be introduced into the entrance tank 13. The refrigerant then flows through each tube 11 of a U-shape and is guided to the exit tank 14 to flow out from a discharge pipe 6. The above-mentioned flow of the refrigerant is a so-called two-path flow.

By integrally form the distribution tank 3 and the distribution pipes in the entrance tank 13, the above-mentioned problem of the layout space is eliminated.

Figure 16:
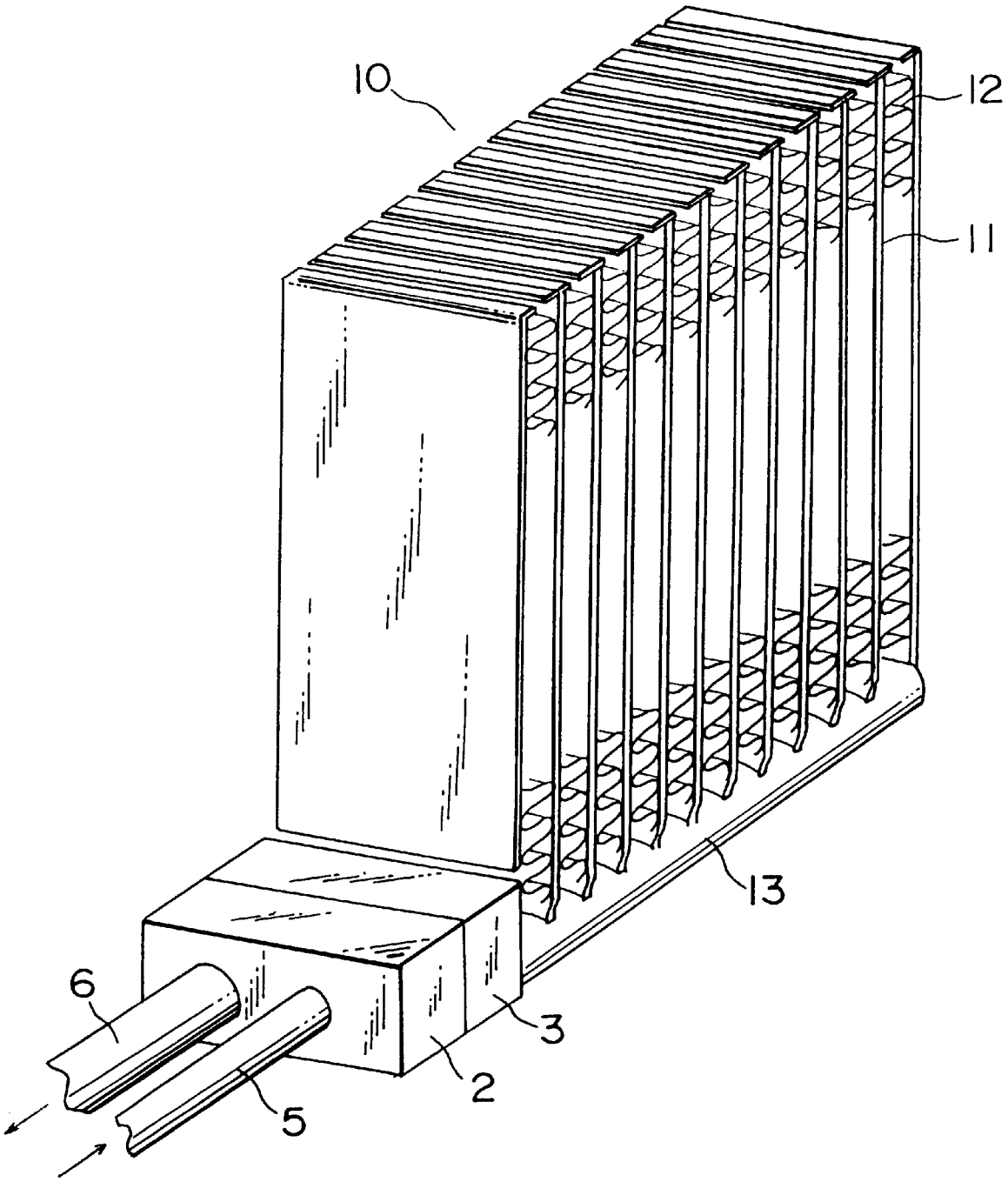
FIG. 16 is a perspective view of a heat exchanger according to a fifth embodiment of this invention.
Figure 17:
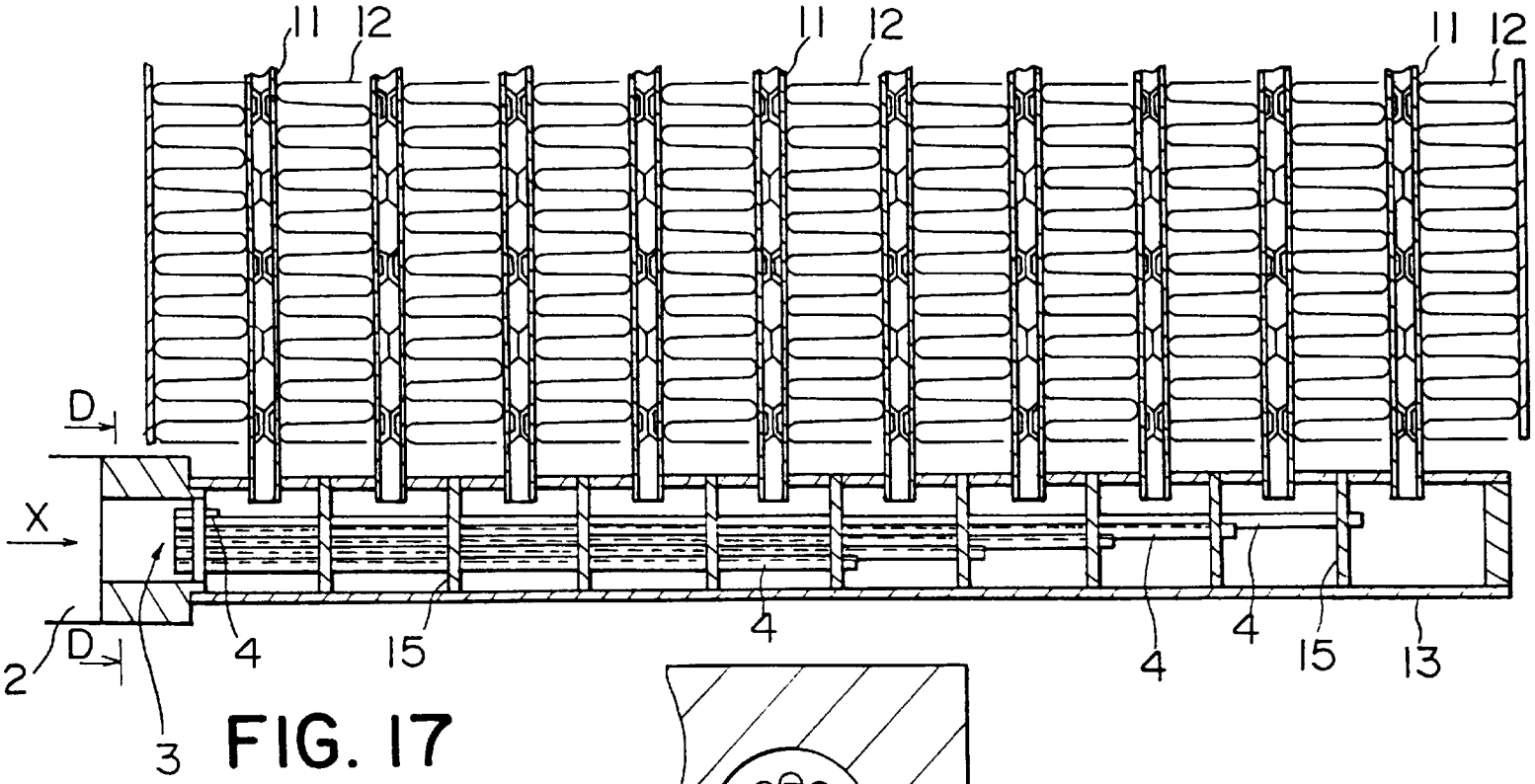
FIG. 17 is a vertical sectional view of a characteristic portion of the heat exchanger illustrated in FIG. 16.
Figure 18:
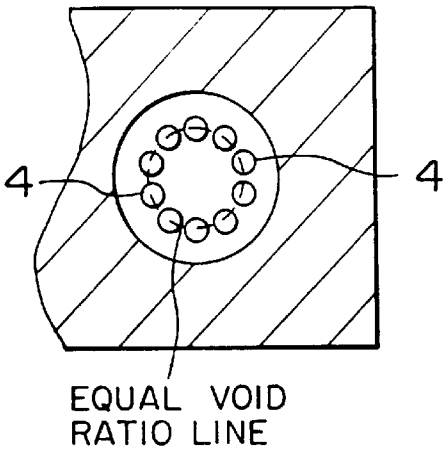
FIG. 18 is a sectional view taken along a line D—D in FIG. 17.
Figure 19:
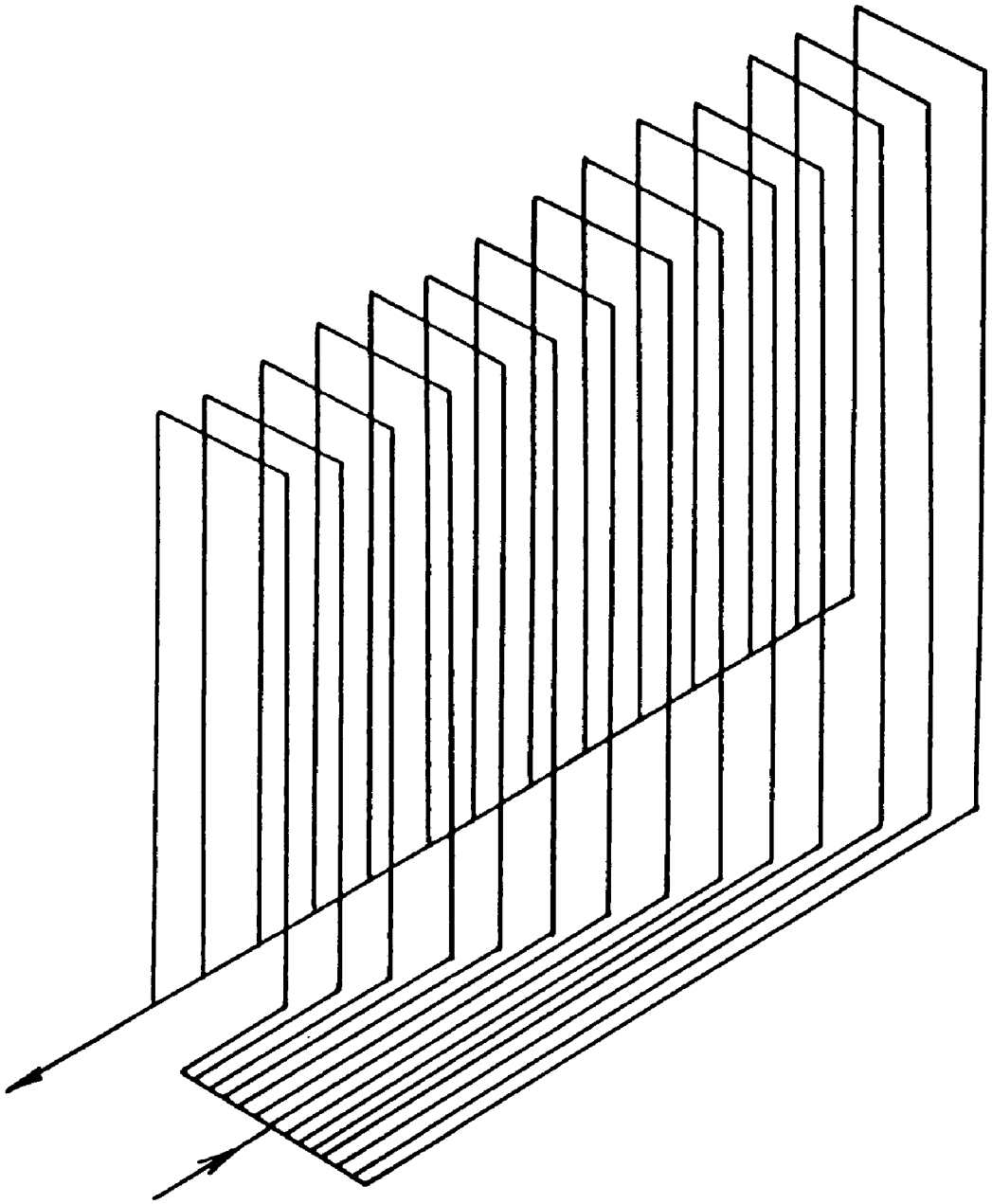
FIG. 19 is a view for describing the flow of a refrigerant in the heat exchanger illustrated in FIG. 16.

Referring to FIG. 16, a heat exchanger 10 according to a fourth embodiment of this invention incorporates a distribution device similar to the distribution device illustrated in FIGS. 5 through 7. In the heat exchanger 10 of this embodiment, similar parts similar to those of the heat exchanger 10 illustrated in FIG. 14 are designated by like reference numerals and will not be described any longer. FIG. 17 shows in section a characteristic portion of the heat exchanger 10. In FIG. 17, the flowing direction of the refrigerant is depicted by an arrow labelled X. FIG. 18 is a sectional view taken along a line D—D in FIG. 17. The flow of the refrigerant in the heat exchanger 10 is illustrated in FIG. 19. In this embodiment, the entrance tank 13 is divided by the partitions 15 into a plurality of the chambers communicating with the respective tubes 11 in one-to-one correspondence. The medium inlet ports of the distribution pipes 4 are arranged in the distribution tank 3 at points of a substantially equal void ratio. On the other hand, the medium outlet ports of the distribution pipes 4 are arranged in the chambers of the entrance tank 13, respectively. In this case, the refrigerant linearly flows into the entrance tank 13 after passing through the throttle portion 2. Therefore, the equal-void-ratio lines are distributed substantially along the concentric circles as shown in FIG. 6. The distribution pipes 4 are arranged along one of the concentric circles as illustrated in FIG. 18.

Figure 20:
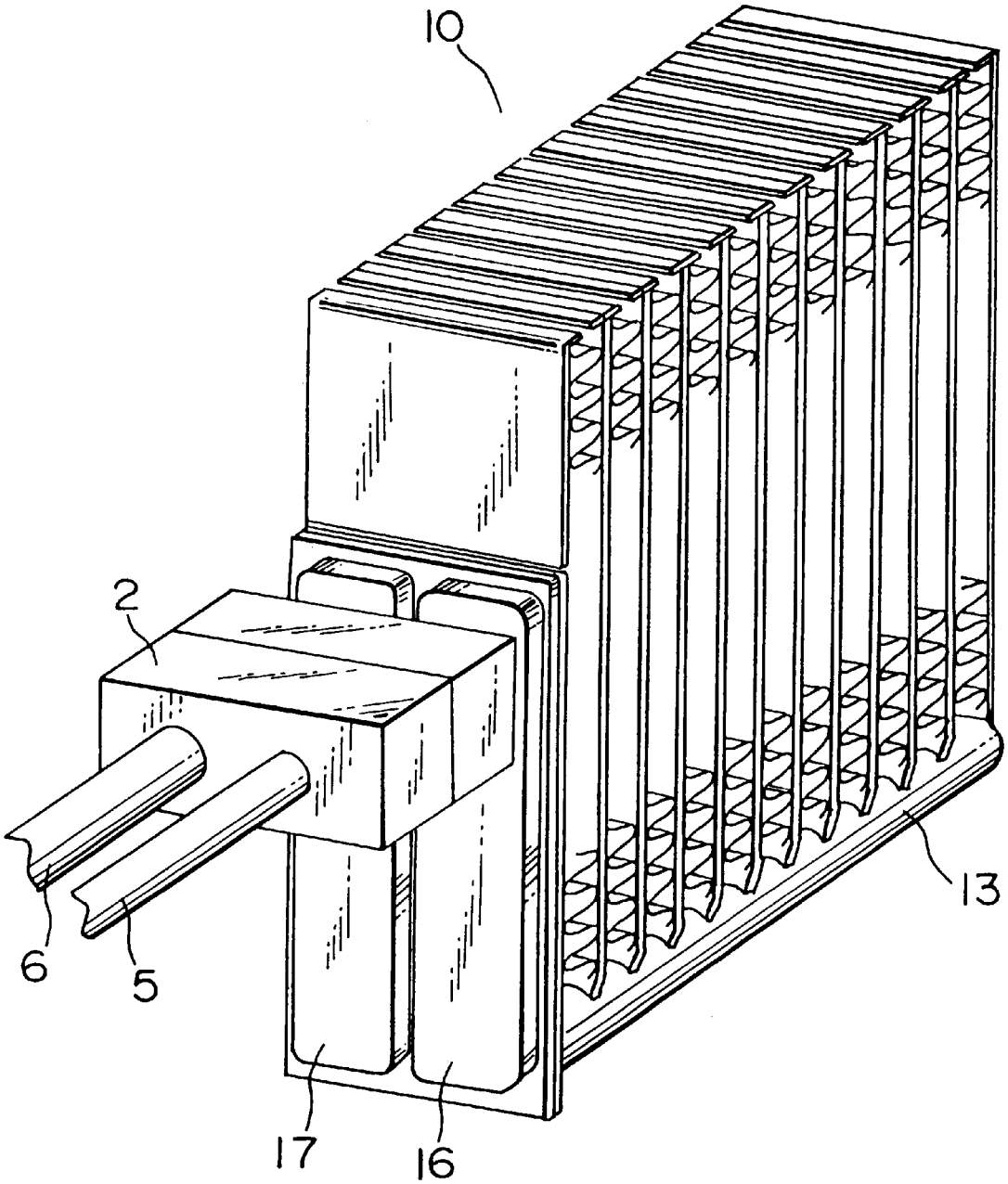
FIG. 20 is a perspective view of a heat exchanger according to a sixth embodiment of this invention.
Figure 21:
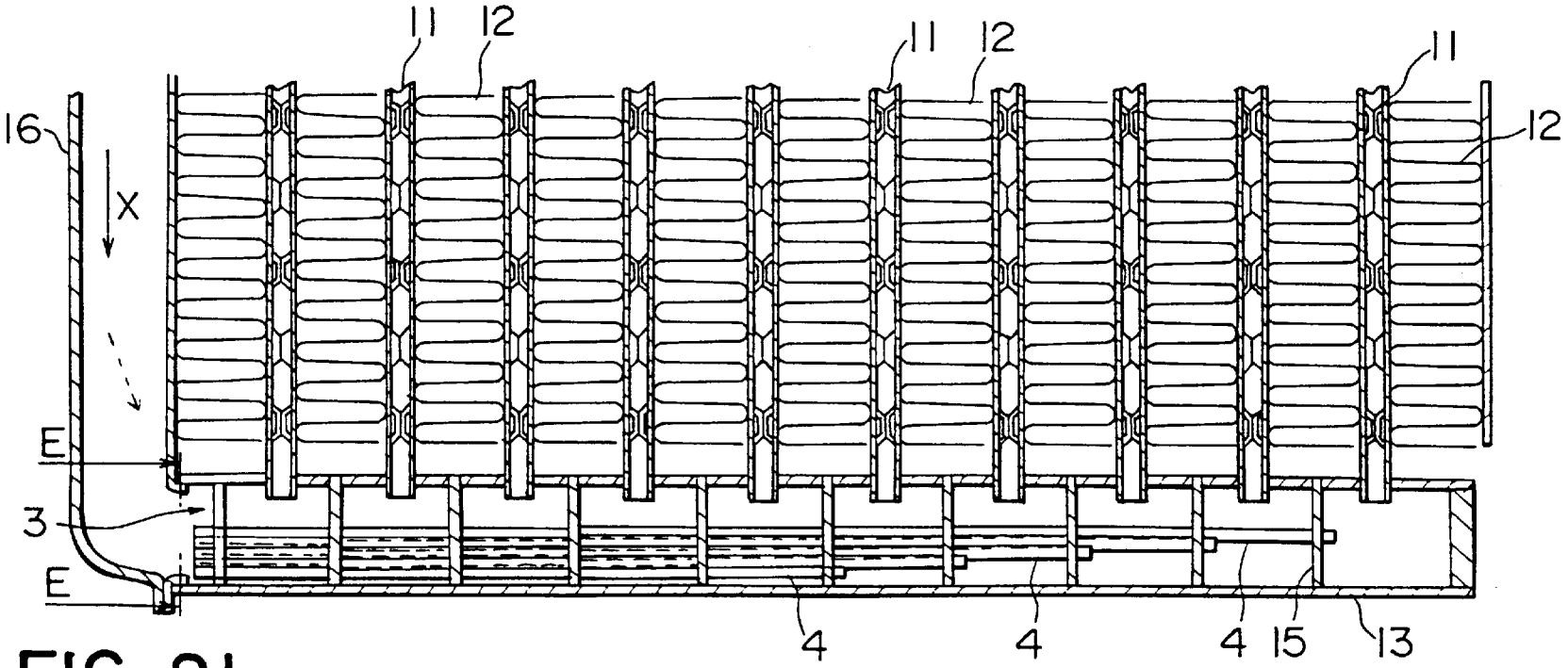
FIG. 21 is a vertical sectional view of a characteristic portion of the heat exchanger illustrated in FIG. 20.
Figure 22:
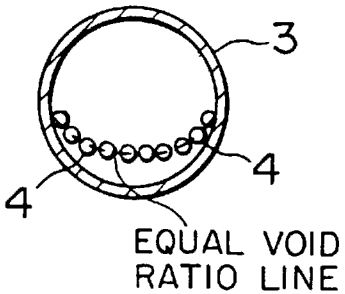
FIG. 22 is a sectional view taken along a line E—E in FIG. 21.

Referring to FIG. 20, a heat exchanger 10 according to a sixth embodiment of this invention is equipped with a distribution device similar to the distribution device 1 illustrated in FIGS. 8 through 10. FIG. 21 shows in section a characteristic portion of the heat exchanger 10 in FIG. 20. In FIG. 21, the flow of the refrigerant is depicted by the arrow labelled X. FIG. 22 is a sectional view taken along a line E—E in FIG. 21. The heat exchanger 10 is provided at its one side with a refrigerant introduction tank 16 for fluid communication between the introduction pipe 5 and the distribution tank 3 and a refrigerant discharge tank 17 for fluid communication between the exit tank 14 and the discharge pipe 6. In the heat exchanger 10, the refrigerant introduction tank 16 (FIG. 20) is relatively long in the flowing direction of the refrigerant. This means that the flow of the medium is substantially along the lengthwise direction of the refrigerant introduction tank 16. In this event, the equal-void-ratio lines in the distribution tank 3 are defined as illustrated in FIG. 9. The distribution pipes 4 are arranged alone one of the equal-void-ratio lines as illustrated in FIG. 22. In this embodiment, the entrance tank 13 is divided by the partitions 15 into the chambers in one-to-one correspondence to the tubes 11, in the manner similar to the embodiment illustrated in FIGS. 17 and 18. The medium inlet ports of the distribution pipes 4 are arranged in the distribution chamber 3 at points of a substantially equal void ratio while the medium outlet ports are arranged in the respective chambers.

If the refrigerant introduction tank 16 is relatively short in the heat exchanger 10 of this embodiment, the flowing direction of the refrigerant is slightly deflected from the lengthwise direction of the refrigerant introduction tank 16 towards the entrance tank 13, as depicted by a dashed-line arrow in FIG. 21. Therefore, the distribution of the void ratio is substantially same as that illustrated in FIG. 12. Although not shown in the figure, the top ends (medium inlet ports) of the distribution pipes 4 are positioned along one of the equal-void-ratio plane.

As described above, in the fifth embodiment illustrated in FIGS. 17 and 18 and the sixth embodiment illustrated in FIGS. 21 and 22, the chambers communicate with the tubes in one-to-one correspondence. In order to reduce the number of the parts or components, the entrance tank of the heat exchanger may be divided into a less number of chambers as far as uniform distribution of the refrigerant is assured. In this case, each chamber does not correspond to each individual tube but communicates with a group of tubes. The distribution pipes equal in number to the chambers are made to communicate with the respective chambers. Herein, it is essential that an equal mass flow of the refrigerant is distributed into each chamber. In the following, description will be directed to several embodiments in which each chamber corresponds not to a single individual tube but to a plurality of tubes.

Figure 23:
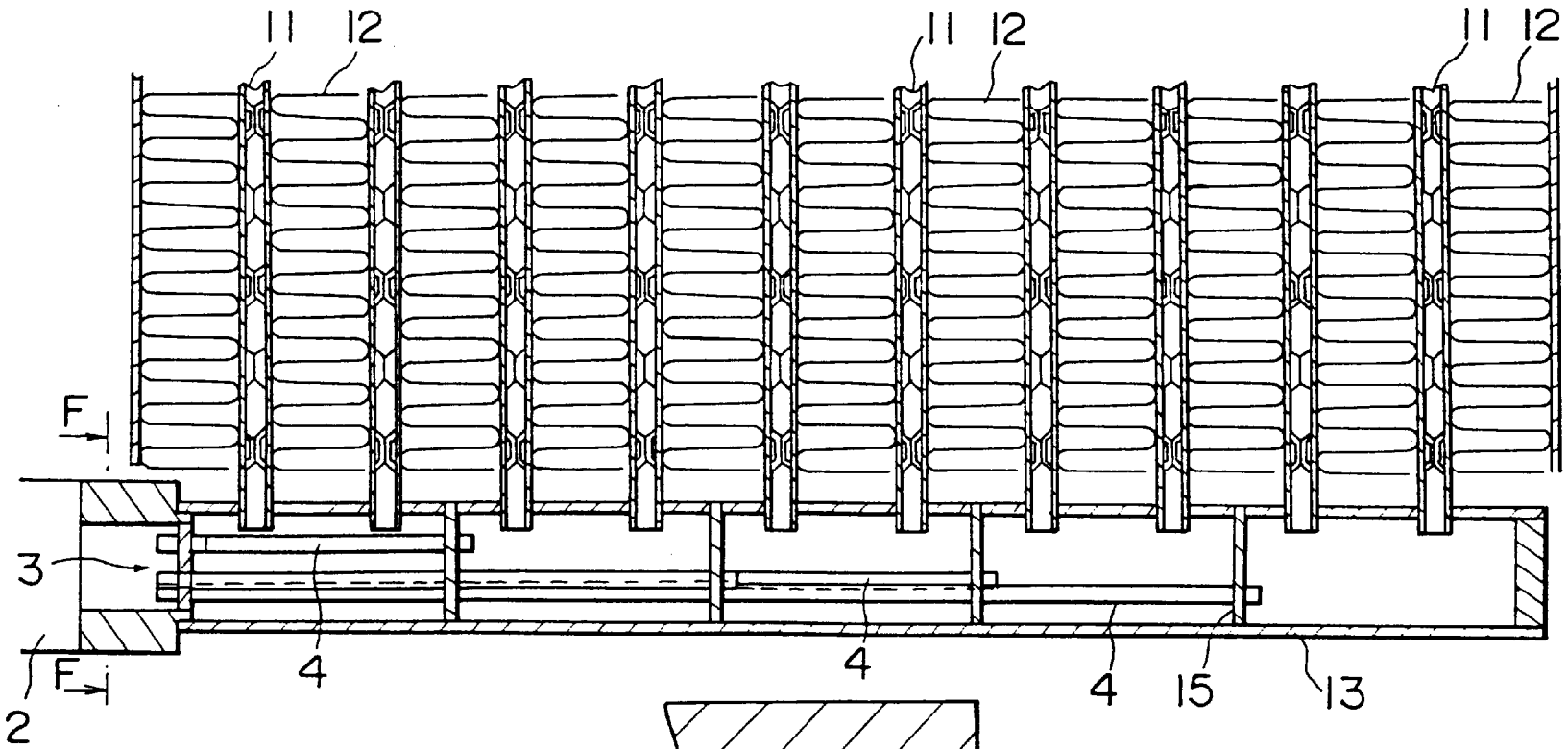
FIG. 23 is a vertical sectional view of a characteristic portion of a heat exchanger according to a seventh embodiment of this invention.
Figure 24:
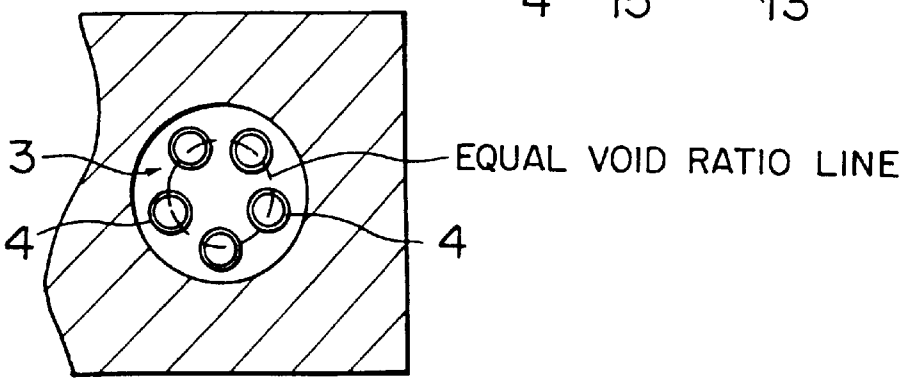
FIG. 24 is a sectional view taken along a line F—F in FIG. 23.

Referring to FIG. 23, an evaporator 10 according to a seventh embodiment of this invention is similar to that illustrated in FIG. 16 except that the partitions 15 are provided at every two tubes to divide the entrance tank 13 into five chambers. The medium outlet ports of the distribution pipes 4 of the same inner diameter are coupled to the chambers in one-to-one correspondence. The medium inlet ports of the distribution pipes 4 are arranged along the equal-void-ratio line as illustrated in FIG. 24.

Figure 25:
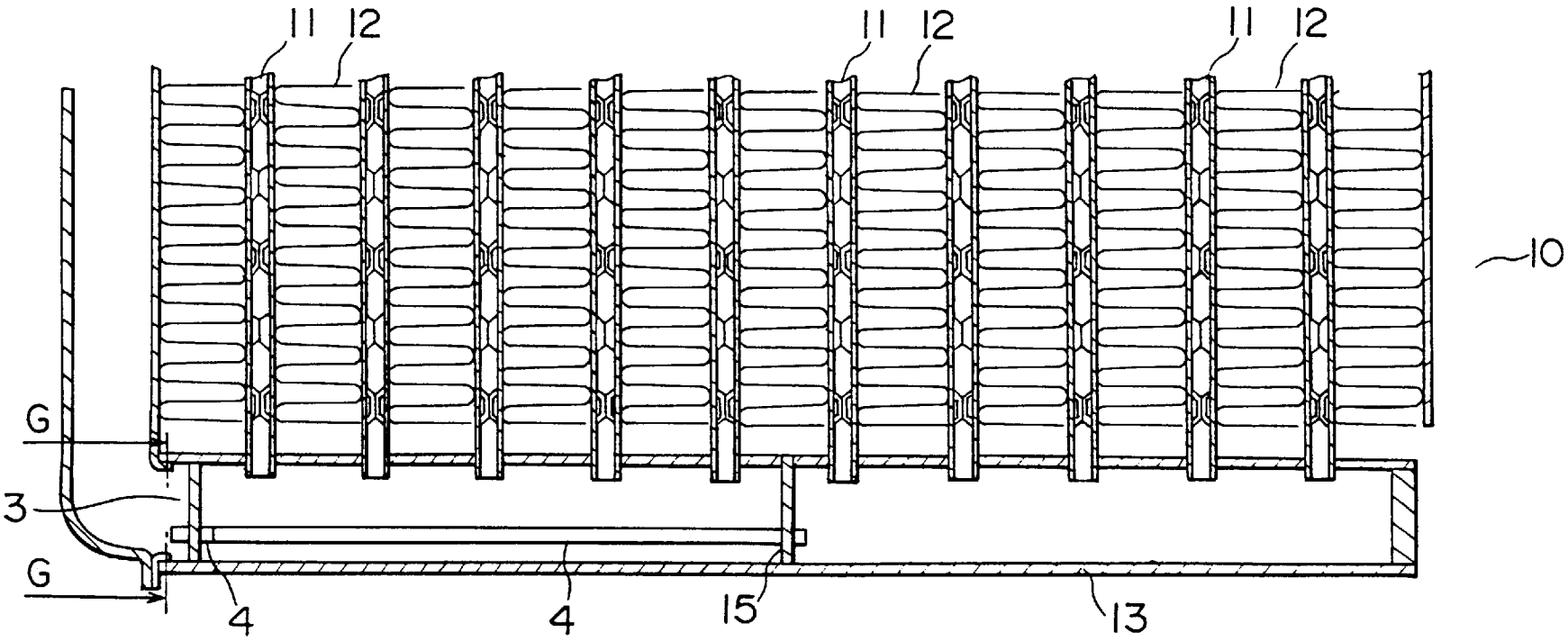
FIG. 25 is a vertical sectional view of a characteristic portion of a heat exchanger according to an eighth embodiment of this invention.
Figure 26:
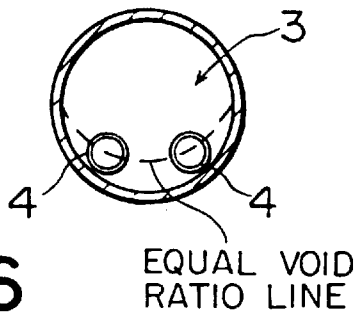
FIG. 26 is a sectional view taken along a line G—G in FIG. 25.

Referring to FIG. 25, an evaporator 10 according to an eighth embodiment of this invention is similar to that illustrated in FIG. 20 except that the partition 15 is provided to separate five tubes from the other five tubes so that the entrance tank 13 is divided into two chambers. The medium outlet ports of the distribution pipes 4 of the equal inner diameter are coupled to the chambers, respectively. The medium inlet ports of the distribution pipes 4 are arranged along the equal-void-ratio line as illustrated in FIG. 26. An equal mass flow of the refrigerant is distributed into each chamber.

Figure 27:
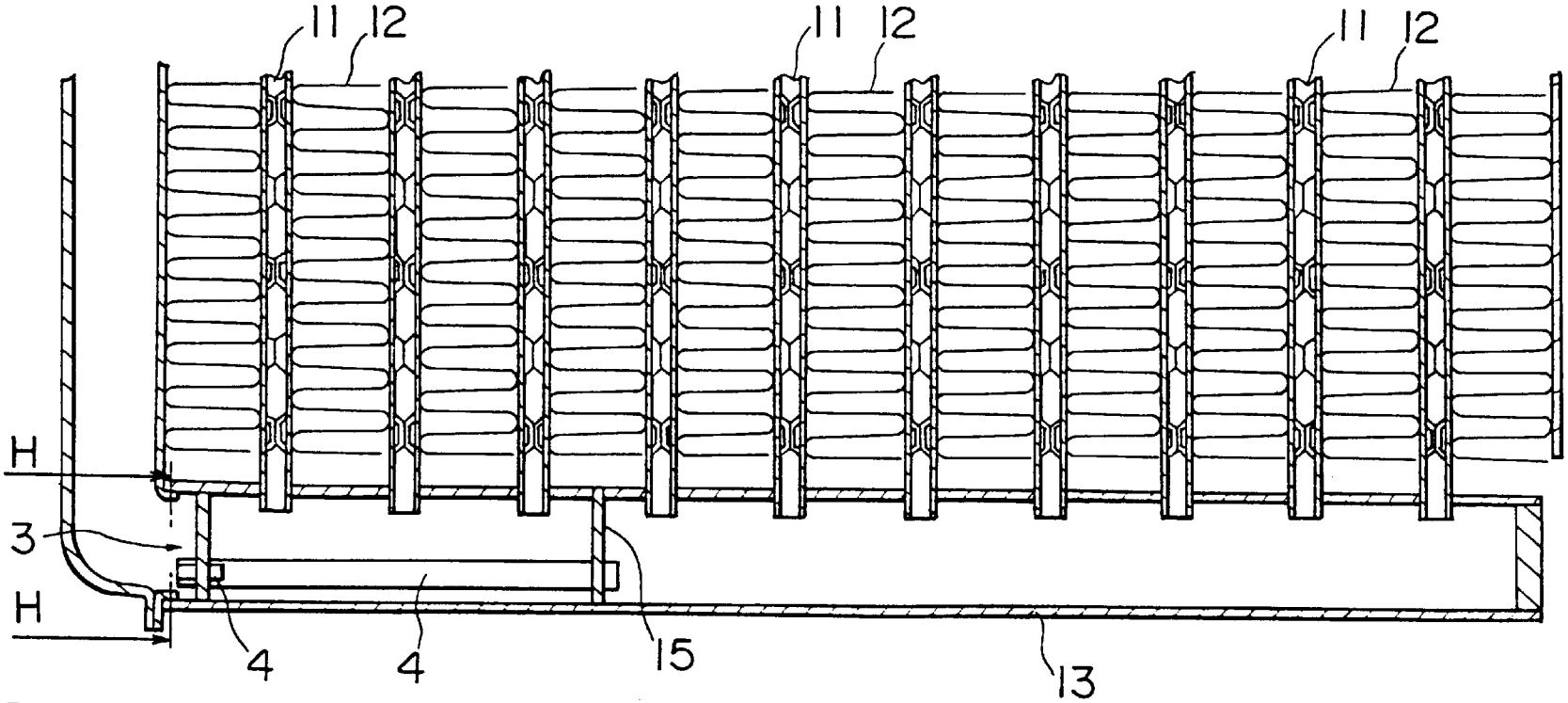
FIG. 27 is a vertical sectional view of a characteristic portion of a heat exchanger according to a ninth embodiment of this invention.
Figure 28:
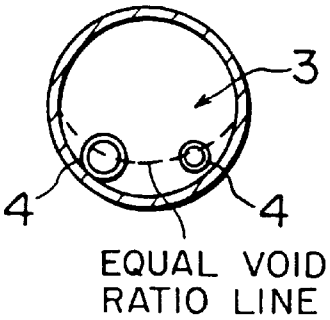
FIG. 28 is a sectional view taken along a line H—H in FIG. 27.

Referring to FIGS. 27 and 28, an evaporator 10 according to a ninth embodiment of this invention is similar to that illustrated in FIG. 20 except that the entrance tank 13 is divided by the partition 15 into two chambers corresponding to different numbers of the tubes. The medium outlet ports of the distribution pipes 4 are coupled to the respective chambers. The distribution pipes 4 have different pipe sectional areas each of which is proportional to the total tube sectional area (or the number of the tubes) in each corresponding chamber. In other words, the distribution pipes 4 are not required to have the same diameter and may have different diameters corresponding to the total tube sectional areas (or the numbers of tubes). With this structure, the mass flow of the refrigerant introduced into each chamber is different but a substantially equal mass flow of the refrigerant is supplied to each tube. It will be understood that the number of the chambers (the number of the distribution pipes) and the sectional areas of the distribution pipes are not restricted to those specified in this embodiment but may be changed as far as the substantially equal mass flow of the refrigerant is supplied to each tube. In case where the tubes have different sectional areas, this will also be taken into consideration.

Figure 29:
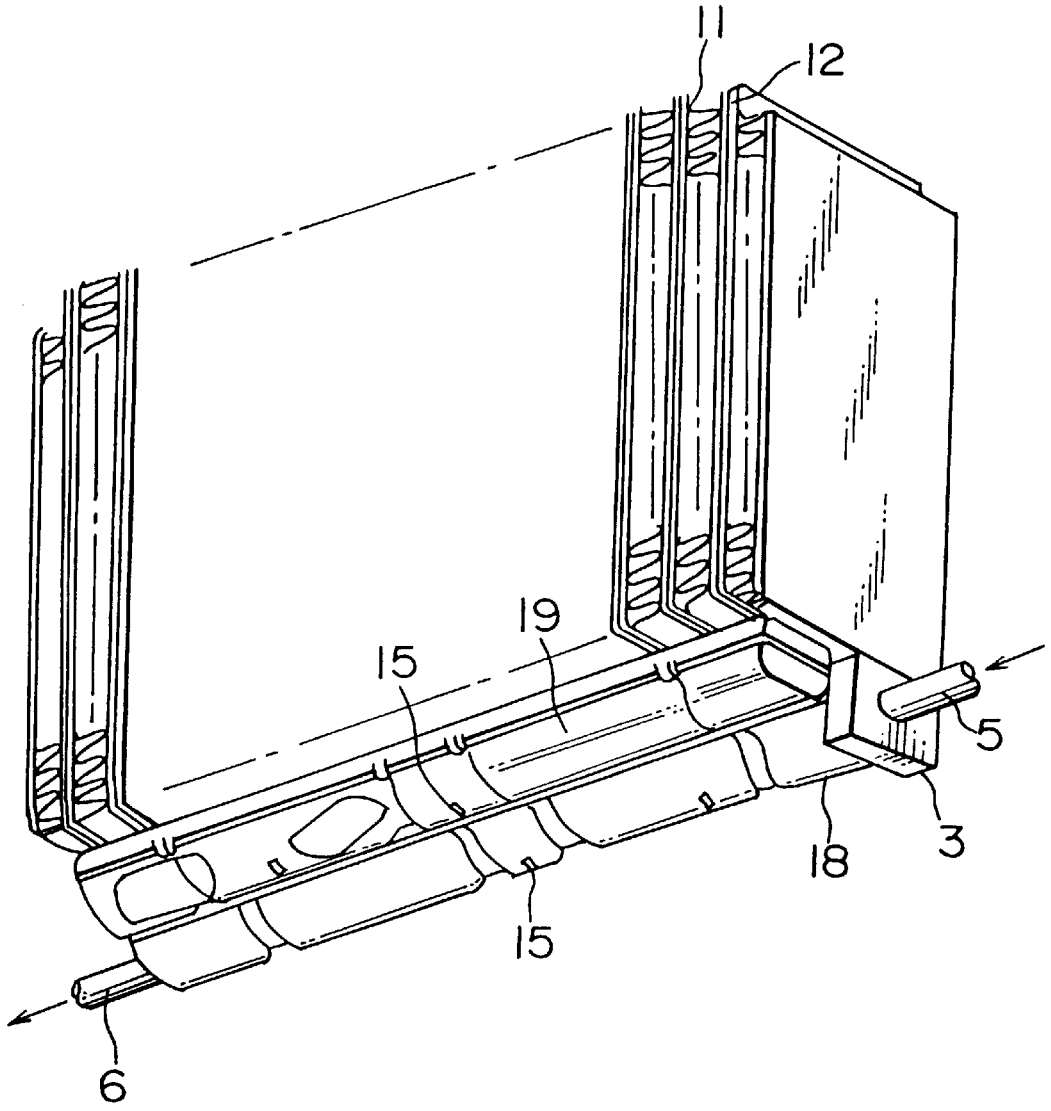
FIG. 29 is a perspective view of a heat exchanger according to a tenth embodiment of this invention.
Figure 30:
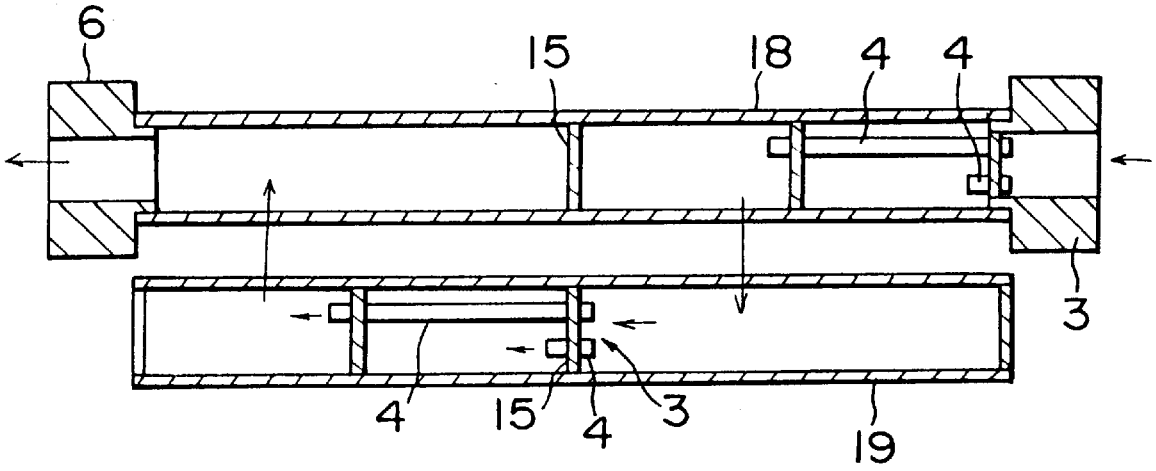
FIG. 30 is a horizontal sectional view of a characteristic portion of the heat exchanger illustrated in FIG. 29.
Figure 31:
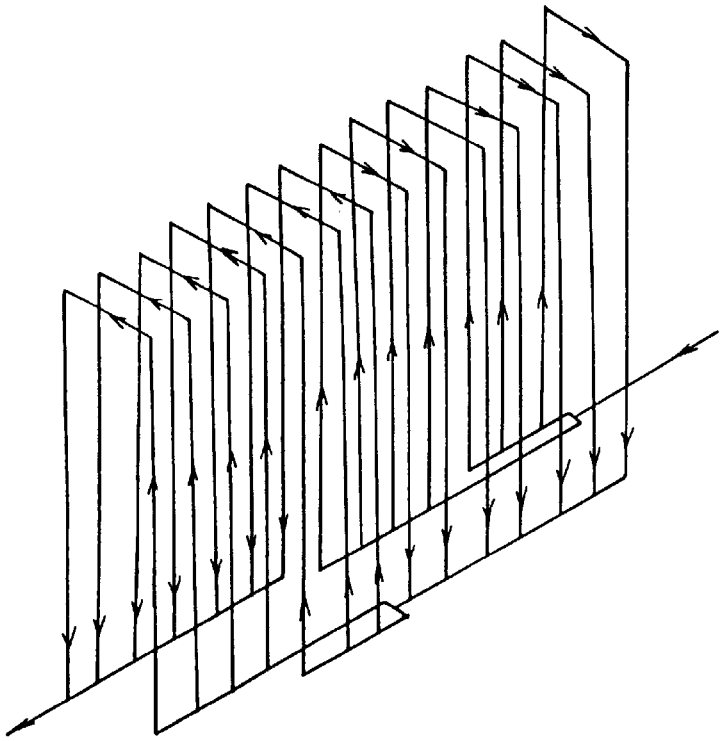
FIG. 31 is a view for describing the flow of a refrigerant in the heat exchanger illustrated in FIG. 31.

Referring to FIGS. 29 and 30, an evaporator according to a tenth embodiment of this invention will be described. The refrigerant flows from the distribution tank 3 through the distribution pipes 4 into an approximate half of a first tank 18 divided by the partition 15. Then, the refrigerant flows through the tubes 11 of a U-shape into an approximate half of a second tank 19. Thereafter, the refrigerant flows towards the other approximate half of the second tank 19. The other approximate half of the second tank 19 is similarly divided into a plurality of chambers respectively coupled to another distribution pipes 4 for fluid communication. The refrigerant flows from the other approximate half of the second tank 19 through the tubes 11 of a U-shape back into the other approximate half of the first tank 18. Finally, the refrigerant is directed to the discharge pipe 6. The above-mentioned flow of the refrigerant is a so-called four-path flow.

In this case, not only the medium inlet ports of the distribution pipes 4 are arranged within the distribution tank 3 substantially along the equal-void-ratio line but also the medium inlet ports of the above-mentioned another distribution pipes 4 are arranged within the approximate half of the second tank 19 substantially along the equal-void-ratio line. This is because gas/liquid separation is caused within the second tank 19 so that the liquid-phase medium and the gas-phase medium are concentrated to different areas remote from and near to the partition 15 of the second tank 19, respectively. This results in temperature distribution.

Again, it will be understood that the number of the chambers (the number of the distribution pipes) and the sectional areas of the distribution pipes are not restricted to those specified in this embodiment but may be varied as far as the substantially equal mass flow of the refrigerant is distributed to each tube.

The distribution pipes 4 may be provided in the second tank 19 alone under the similar technical concept.

The foregoing embodiments have been described in conjunction with the evaporators of a drawn cup type. However, this invention is applicable not only to the evaporators of such type but also to various types of heat exchangers as far as a tank is provided.

As described above, according to this invention, it is possible to uniformly distribute the medium to a plurality of the tubes of the heat exchanger. As a result, the temperature distribution in the heat exchanger is suppressed so that the efficiency of the heat exchanger can be improved.

What is claimed is:

1. A distribution device for use in combination with a heat exchanger, said distribution device comprising a distribution tank supplied with a mixed-phase gas medium and a liquid-phase medium, and a plurality of distribution paths, each of which has a medium inlet port and a medium outlet port coupled to said distribution tank and said heat exchanger, respectively, and which are for directing said mixed-phase medium from said distribution tank to said heat exchanger, wherein:

said medium inlet ports of the plurality of distribution paths are coupled to said distribution tank substantially along an equal void ratio plane defined by connecting those points of said distribution tank which are equal in a void ratio to each other, where said void ratio is defined as a ratio of the volume of said gas-phase medium to the volume of both said gas-phase medium and said liquid-phase medium, and wherein said distribution paths extend though a wall of said distribution tank to said void ratio plane.

2. A distribution device as claimed in claim 1, said heat exchanger having a plurality of exchanger tubes (11), wherein said medium outlet ports of the plurality of distribution paths are coupled to said plurality of exchanger tubes, respectively.

3. A distribution device as claimed in claim 1, said heat exchanger having a plurality of tube groups, each tube group comprising at least one exchanger tube (11), wherein said medium outlet ports of the plurality of distribution paths are coupled to said plurality of tube groups, respectively.

4. A combination of a heat exchanger and a distribution device, said distribution device comprising a distribution tank supplied with a mixed-phase medium consisting essentially of a gas-phase medium and a liquid-phase medium, and a plurality of distribution paths, each of which has a medium inlet port and a medium outlet port coupled to said distribution tank and said heat exchanger, respectively, and which are for directing said mixed-phase medium from said distribution tank to said heat exchanger, wherein:

said medium inlet ports of the plurality of distribution paths are coupled to said distribution tank substantially along an equal void ratio plane defined by connecting those points of said distribution tank which are equal in a void ratio to each other, where said void ratio is defined as a ratio of the volume of said gas-phase medium to the volume of both said gas-phase medium and said liquid-phase medium, and wherein said distribution paths extend though a wall of said distribution tank to said void ratio plane.

5. A combination as claimed in claim 4, said heat exchanger having a plurality of exchanger tubes (11), wherein said medium outlet ports of the plurality of distribution paths are coupled to said plurality of exchanger tubes, respectively.

6. A combination as claimed in claim 4, said heat exchanger having a plurality of tube groups, each tube group comprising at least one exchanger tube (11), wherein said medium outlet ports of the plurality of distribution paths are coupled to said plurality of tube groups, respectively.

7. A combination as claimed in claim 4, said heat exchanger having an exchanger entrance tank (13), wherein said distribution device is disposed in said entrance tank.

8. A combination as claimed in claim 4, said heat exchanger having an exchanger entrance tank (13), wherein said distribution device is coupled to said entrance tank.

9. A combination as claimed in claim 4, said heat exchanger having an exchanger entrance tank (13), wherein:

said exchanger entrance tank comprises a plurality of chambers which are divided by partitions (15) and which are coupled to a plurality of tube groups, respectively, each tube group comprising at least one exchanger tube (11);

said medium outlet ports of the plurality of distribution paths being coupled to said plurality of chambers, respectively.

* * * * *